US006307523B1

(12) United States Patent
Green et al.

(10) Patent No.: US 6,307,523 B1
(45) Date of Patent: Oct. 23, 2001

(54) ANTENNA APPARATUS AND ASSOCIATED METHODS

(75) Inventors: Dennis Arnold Green, Vero Beach; David Samuel Albert, Melbourne; William Charles Daffron, III, Cocoa, all of FL (US)

(73) Assignee: Harris Corporation, Melbourne, CA (US)

( * ) Notice: Subject to any disclaimer, the term of this patent is extended or adjusted under 35 U.S.C. 154(b) by 0 days.

(21) Appl. No.: 09/570,876

(22) Filed: May 15, 2000

(51) Int. Cl.[7] ..... H01Q 3/12
(52) U.S. Cl. ..... 343/781 CA; 343/782
(58) Field of Search ..... 343/781 CA, 781 R, 343/782, 872, 757

(56) References Cited

U.S. PATENT DOCUMENTS 2,572,088 * 10/1951 Young et al. ..... 250/8
3,611,394 * 10/1971 Parker ..... 343/781
5,025,493 6/1991 Cook et al. ..... 342/374
5,194,874 3/1993 Perrotta et al. ..... 343/757
5,351,060 9/1994 Bayne ..... 343/766

* cited by examiner

*Primary Examiner*—Don Wong
*Assistant Examiner*—James Clinger
(74) *Attorney, Agent, or Firm*—Allen, Dyer, Doppelt, Milbrath & Gilchrist, P.A.

(57) ABSTRACT

An antenna apparatus includes an antenna feed, a radio frequency (RF) receiver connected to the antenna feed, and a main reflector for reflecting received RF signals to the antenna feed along a received signal path. The antenna apparatus may also include a sub-reflector positioned in the received signal path for reflecting received RF signals from the main reflector to the antenna feed. Furthermore, received RF signals may be modulated by blocking the RF signals in the received signal path. A tracking controller is connected to the RF receiver for generating an antenna pointing control signal based upon modulated received RF signals. Preferably, the received RF signals are at least partially blocked with a body which is movable in the received signal path.

51 Claims, 3 Drawing Sheets

ANTENNA APPARATUS AND ASSOCIATED METHODS

FIELD OF THE INVENTION

The present invention relates to the field of Radio Frequency (RF) communication, and, more particularly, to tracking targets with an antenna.

BACKGROUND OF THE INVENTION

Communication from a stationary or vehicle-based antenna to a skyborne target such as a polar orbiting satellite, a geosynchronous satellite, or an airplane, etc., may require automatic tracking. Various types of reflector antennas are known, and various techniques of generating offset beams, for example, conical scanning, sequential lobing, and single channel monopulse, have proven to be acceptable for automatic tracking of targets.

Typical conical scanning involves the principle of generating an offset beam about the focal axis (tracking axis or boresight) by using a single feed element which is offset and rotated about the focal axis. There are many variations of conical scanning. In general, a conical scan can be produced either electrically (by varying electrical parameters of the antenna) or mechanically (by rotating a component of the antenna).

A Cassegrain reflector antenna includes a parabolic dish for focusing the received signal onto a secondary reflector, or sub-reflector, having a hyperbolic profile, which refocuses the signal onto a feed, located in the center of the parabolic dish. A ring focus reflector antenna is similar to the Cassegrain except that dish is a section of a parabola and the feed is located offset from the center of the dish. The ring focus design is valued for its excellent RF performance in gain, side lobes and efficiency. In the Cassegrain or ring focus configurations, the sub-reflector may be rotated at high speed so as to obtain a mechanical conical nutation within a certain angle of rotation which defines the scan region covered by the antenna beam.

The conical scan can determine errors in the positioning of the antenna, since the amplitude of the received signal will be modulated by the mechanical nutation imparted by the rotating element. When an optimal position has been determined for the antenna, an antenna positioning device, typically an elevation over azimuth actuator, is used to finally position the antenna structure. The primary advantage of conical scanning is its low implementation cost, relative to monopulse.

Single Channel Monopulse (SCM) utilizes a feed, in typically four or five element configurations, and a combining network to generate a reference signal and azimuth and elevation difference signals of a monopulse feed. The azimuth and elevation difference signals are biphase modulated and sequentially coupled to the reference signal. The resultant signal is similar to conical scanning signals because the combined reference and difference signal produces an offset beam relative to the focal axis. However, monopulse tracking feeds are relatively expensive and may not be retrofitted to existing antennas.

SUMMARY OF THE INVENTION

In view of the foregoing background, it is therefore an object of the invention to provide a low cost tracking technique that can be implemented on existing and new antenna systems.

This and other objects, features and advantages in accordance with the present invention are provided by an antenna apparatus comprising an antenna feed, a radio frequency (RF) receiver connected to the antenna feed, and a main reflector for reflecting received RF signals to the antenna feed along a received signal path. Also, a sub-reflector is preferably positioned in the received signal path for reflecting received RF signals from the main reflector to the antenna feed. A body in the received signal path has at least one predetermined characteristic to modulate received RF signals. A tracking controller is connected to the RF receiver for generating an antenna pointing control signal based upon modulated received RF signals.

The body may at least partially block received RF signals and not block other RF signals.

Also, the body is preferably movable in the received signal path between the main reflector and the sub-reflector and may be rotatably mounted adjacent the sub-reflector. The body may modulate received RF signals by at least partially blocking received RF signals in a predetermined pattern in the received signal path. The apparatus may include a drive for rotating the body, with a counterweight for the body connected to the drive. The tracking controller preferably controls the speed of the drive. Also, a position sensor may be connected to the tracking controller for sensing a position of the body. The tracking controller may also determine an antenna pointing error, wherein the controller also generates the antenna pointing control signal based upon the antenna pointing error. The main reflector may comprise a parabolic dish having the antenna feed positioned at an apex thereof, or the main reflector may comprise a parabolic section-shaped dish having the antenna feed positioned offset from an apex thereof.

Features and advantages in accordance with the present invention are also provided by a method of tracking a target with the antenna apparatus including the steps of modulating received RF signals by at least partially blocking received RF signals in a predetermined pattern in the received signal path. Preferably, the method includes modulating received RF signals by moving a body in the received signal path, and generating an antenna pointing control signal based upon modulated received RF signals. Again, the body has at least one predetermined characteristic to modulate received RF signals, which may comprise at least partially blocking received RF signals, and not blocking other RF signals.

The antenna may further include a sub-reflector positioned in the received signal path for reflecting received RF signals from the main reflector to the antenna feed, and thus the body may preferably be movable in the received signal path between the main reflector and the sub-reflector. Moving the body may comprise rotating the body with a motor, and controlling the speed of the motor. Also, the method may include sensing a position of the body. An antenna pointing error may also be determined and the antenna pointing control signal may be generated based upon the antenna pointing error.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
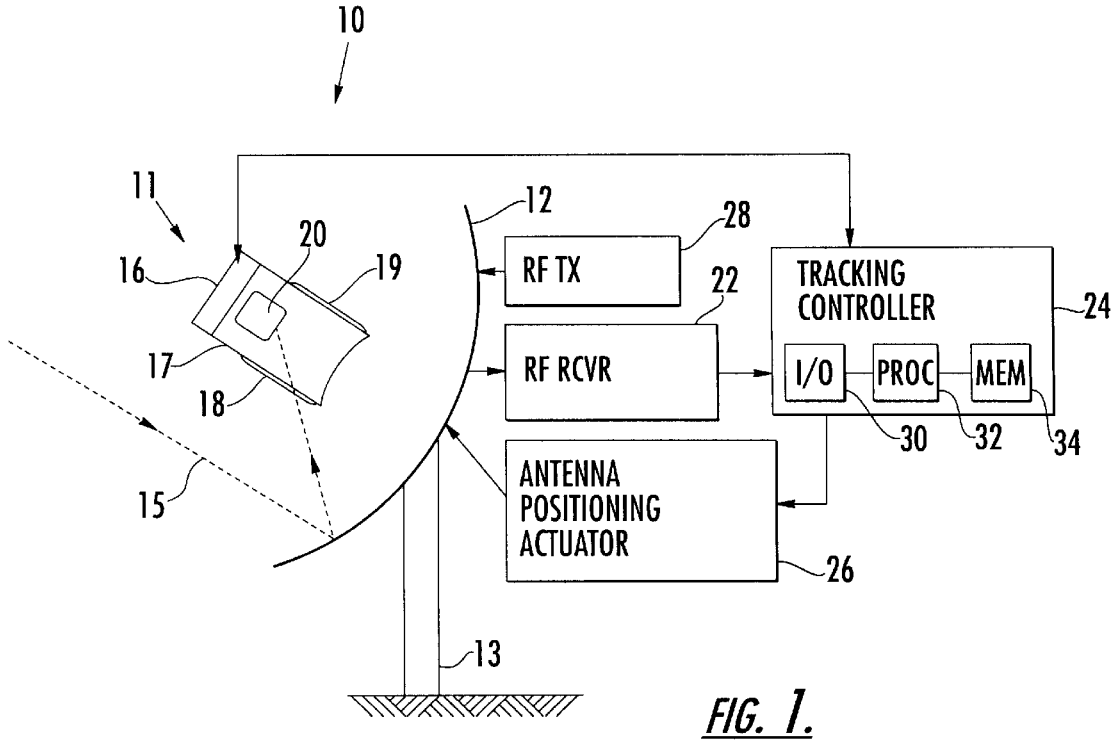
FIG. 1 is a schematic diagram of an antenna apparatus according to an embodiment of the present invention.

Referring to FIG. 1, a first embodiment of an antenna apparatus 10 in accordance with the present invention will now be described. The antenna apparatus 10 may be for two-way communications with a skyborne target, such as a polar orbiting satellite, a geosynchronous satellite, or an airplane, etc., or for radar applications. The antenna 10 includes a main reflector 12 including a parabolic dish which is typically produced from aluminum or other materials and is available in a range of sizes, as would be appreciated by the skilled artisan. The main reflector 12 may be mounted on a support structure 13 positioned so that the focal point of its parabolic surface lies at an antenna feed 20. An incoming RF signal is thus reflected in a received signal path 15 from the surface of the main reflector 12 upon the antenna feed 20 positioned adjacent the center of the main reflector. The antenna feed 20, such as a feed horn, may be supported by a monopod, tripod or quadropod, for example, and is typically connected to one or more conventional RF down convertors or RF receivers 22 as also would be readily appreciated by those skilled in the art.

A tracking controller 24 is connected to the RF receiver 22 and may modify the antenna apparatus 10 to produce a desired antenna beam pattern. The tracking controller 24 illustratively includes an interface 30 for communication with other antenna devices, a processor 32 and a memory 34, for storing data and/or the set of instructions which the processor may use to perform necessary antenna control and other typical antenna functions. The tracking controller 24 may generate antenna pointing control signals, and may also determine antenna pointing errors during the tracking of the skyborne target. These and other signals may be provided to an antenna positioning actuator 26 for positioning the antenna apparatus 10 to produce the desired beam pattern. The antenna apparatus 10 may also include an RF transmitter 28 for communication with the skyborne target as would be appreciated by the skilled artisan.

A type of conical scan device 11 illustratively includes a body 18 carried by a support member 17 and movable by drive 16 in the received signal path 15. The drive 16 is preferably a flat rotary DC motor which rotates the body 16 about an axis and is preferably mounted, for example, adjacent the antenna feed 20 and opposite the main reflector 12. A counterweight body 19 may also be carried by the support 17 to prevent a rotating imbalance.

Figure 4:
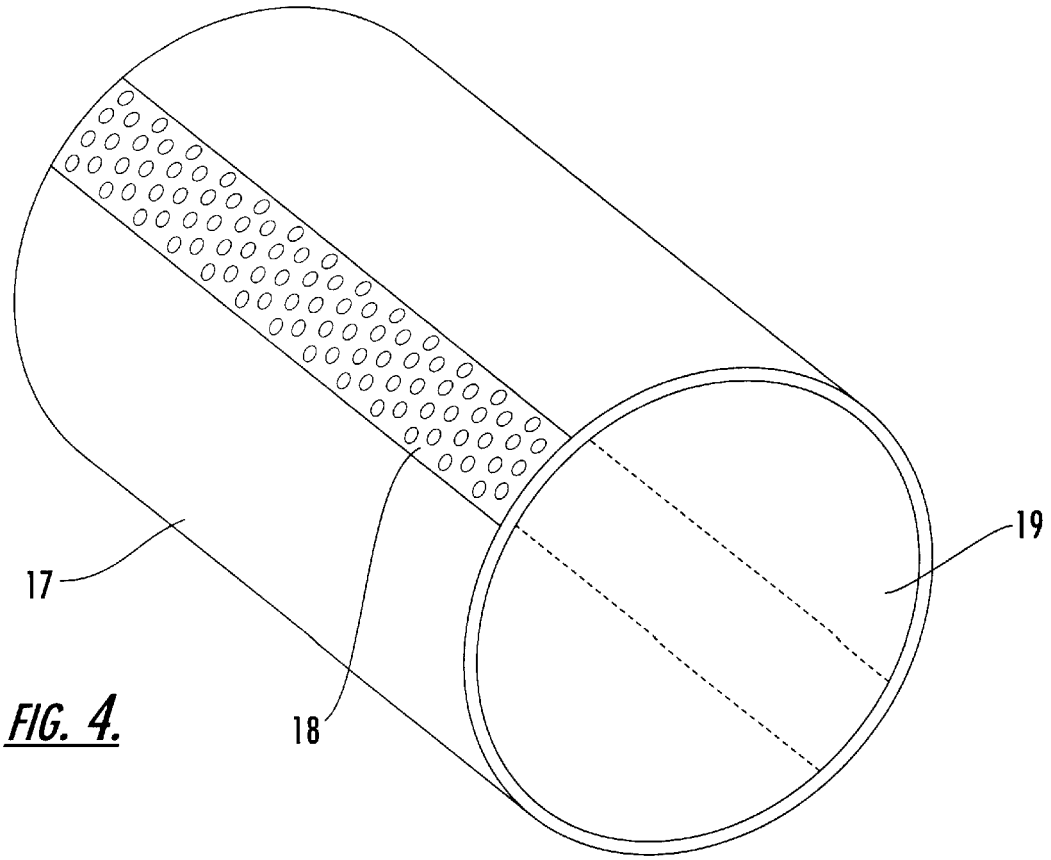
FIG. 4 is a perspective side view of the movable body according to the present invention.

Referring to FIG. 4, the support 17 of the conical scan device 11 may be, for example, a cylinder having the movable body 18 and counterweight body 19 positioned along opposing outer surfaces thereof. For example, the cylinder may be about 4 inches in length and 6–8 inches in diameter while the movable body may be 1 inch wide and extending down the cylinder. The body 18 has at least one predetermined characteristic to modulate RF signals. For example, the body 18 preferably blocks incoming RF signals and may include a tab or strip of an RF opaque material or a frequency dependent RF opaque material. Such a frequency dependent RF opaque material may block only the receive signal if the receive and transmit frequencies are different. For example, such RF opaque materials may include geometrical patterns and/or other materials which may substantially absorb or reflect desired RF signals as would be appreciated by the skilled artisan. Furthermore, various materials may be controlled to vary in RF transparency or opaqueness. Also, the size and shape of the movable body 18 may be selected for a desired tracking sensitivity.

The drive 16 preferably rotates at a constant but adjustable rate and the portion of the incoming RF signal blocked by the body 18 rotates about the axis. For relatively slow moving targets, such as a geostationary satellite, the drive 16 may rotate at about 10 rpm, for example. However, for relatively faster moving targets, such as a missile, the drive may rotate at about 1000 rpm, for example. The controller 24 detects the drive speed and the position of the body 18 with a tachometer loop having, for example, a sensor on the drive 16. The drive speed and body 18 position are combined with the received amplitude modulated RF signal strength to create a relationship between incoming RF signal and the angle of the movable body 18. From this relationship, the direction and relative magnitude of the pointing error between the antenna apparatus 10 and the target can be determined.

Figure 6:
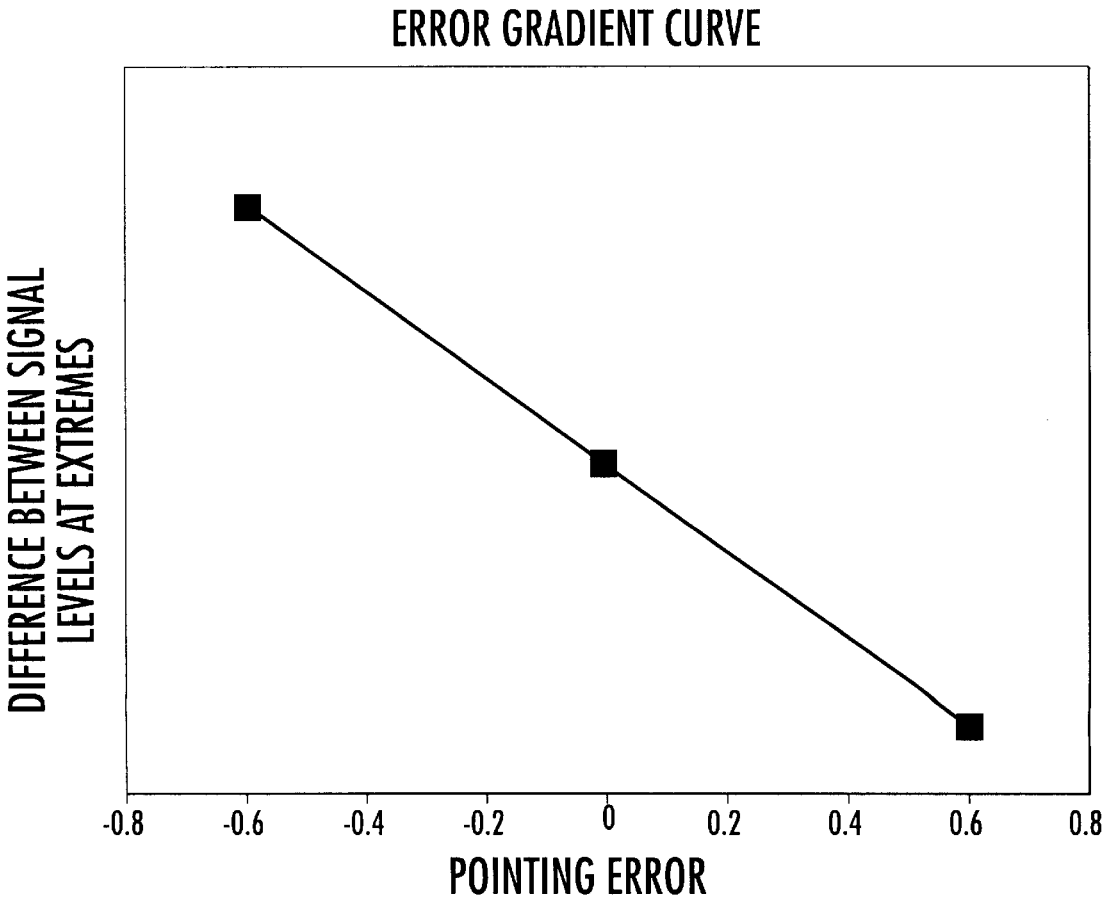
FIG. 6 is a graph of an example of a measured error gradient curve in accordance with the embodiments of the present invention.

The determination of direction and relative magnitude of pointing error is accomplished because the movable body 18 blocks out different portions of incoming RF signals depending on the movable body's position. For a given pointing error, the movable body 18 blocks out more signal when the movable body is in the direction of the target and less signal when it is on the opposite side. The difference between signal levels at these two extremes is a function of the magnitude of the pointing error. For example, at zero pointing error, the movable body 18 blocks out equal amounts of incoming RF signal at all movable body positions. By noting the movable body position when the incoming RF signal is weakest and strongest, and by comparing the maximum and minimum measured incoming signals, the direction and relative magnitude of pointing error is obtained. An error gradient curve may be empirically generated. The tracking controller 24 may then generate an antenna pointing control signal to track the target, and the position of the antenna apparatus 10 may then modified to reduce the magnitude of the pointing error and thus improve the alignment of the antenna apparatus. An example of a measured error gradient curve is shown in FIG. 6. The measured data points create a line having a slope which is the error gradient.

Figure 2:
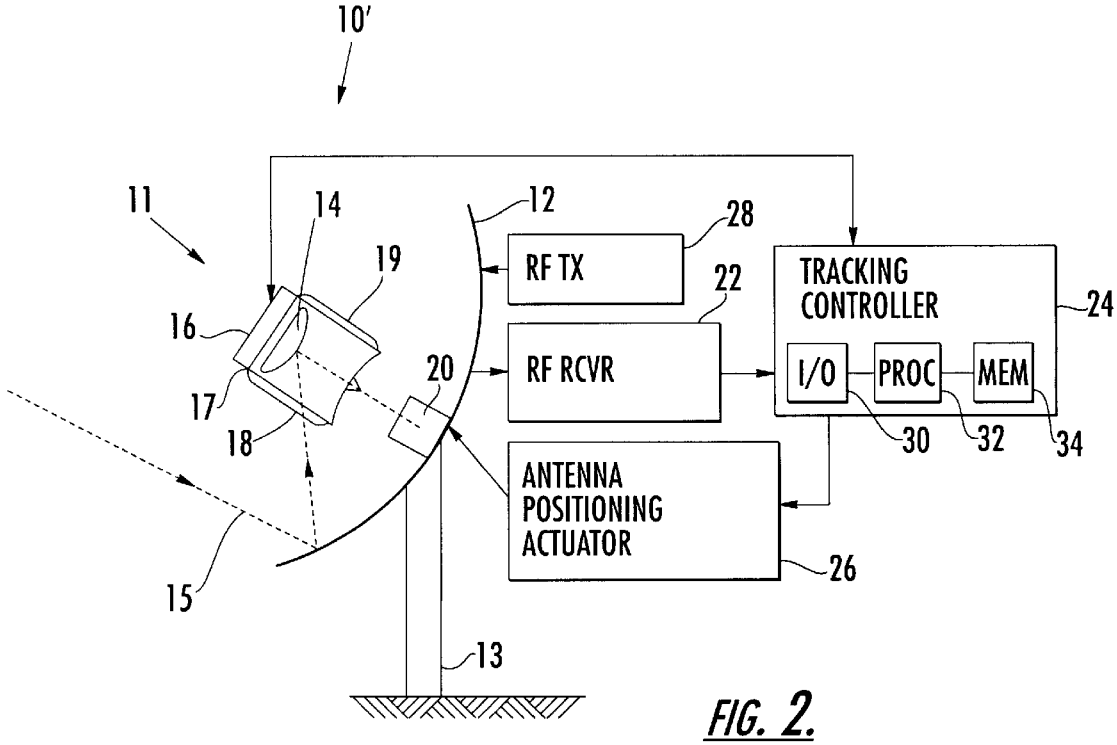
FIG. 2 is a schematic diagram of an antenna apparatus according to another embodiment of the present invention.

Referring to FIG. 2, an antenna apparatus 10' according to another embodiment of the present invention will now be described. Here, the antenna apparatus 10 is a Cassegrain antenna having a main reflector 12 and a secondary reflector or sub-reflector 14. Again, the main reflector 12 includes a parabolic dish. The Cassegrain sub-reflector 14 has a substantially hyperbolic reflector surface and is mounted on a support structure positioned so that the focal point of its hyperbolic surface lies at the vertex of the parabolic dish of the main reflector 12. An incoming RF signal is thus reflected from the surface of the main reflector 12, off the surface of the sub-reflector 14, which is focused upon an antenna feed 20 at the center of the main reflector.

The antenna feed 20, such as a feed horn, may be supported by a monopod, for example, and is typically connected to a receiver 22. The dimensions and shape of the sub-reflector 14 and of the antenna feed 20 are determined so that the received signal is focused into the antenna feed. The sub-reflector 14 needs to be wide enough to receive substantially all the signal from the main reflector 12 to maximize the strength of the signal focused onto the antenna feed 20.

The tracking controller 24 is connected to the receiver 22. As discussed above, the tracking controller 24 may generate antenna pointing control signals, and may also determine antenna pointing errors during the tracking of a skyborne target. In this embodiment, the conical scan device 11 includes the body 18 carried by the support member 17 and driven by drive 16 to intercept the signal path 15 between the main reflector 12 and the sub-reflector 14 as shown in FIG. 2. The drive 16 is preferably mounted, for example, adjacent the sub-reflector 14 and opposite the main reflector 12. The counterweight body 19 may also be carried by the support 17 to prevent a rotating imbalance.

Figure 3:
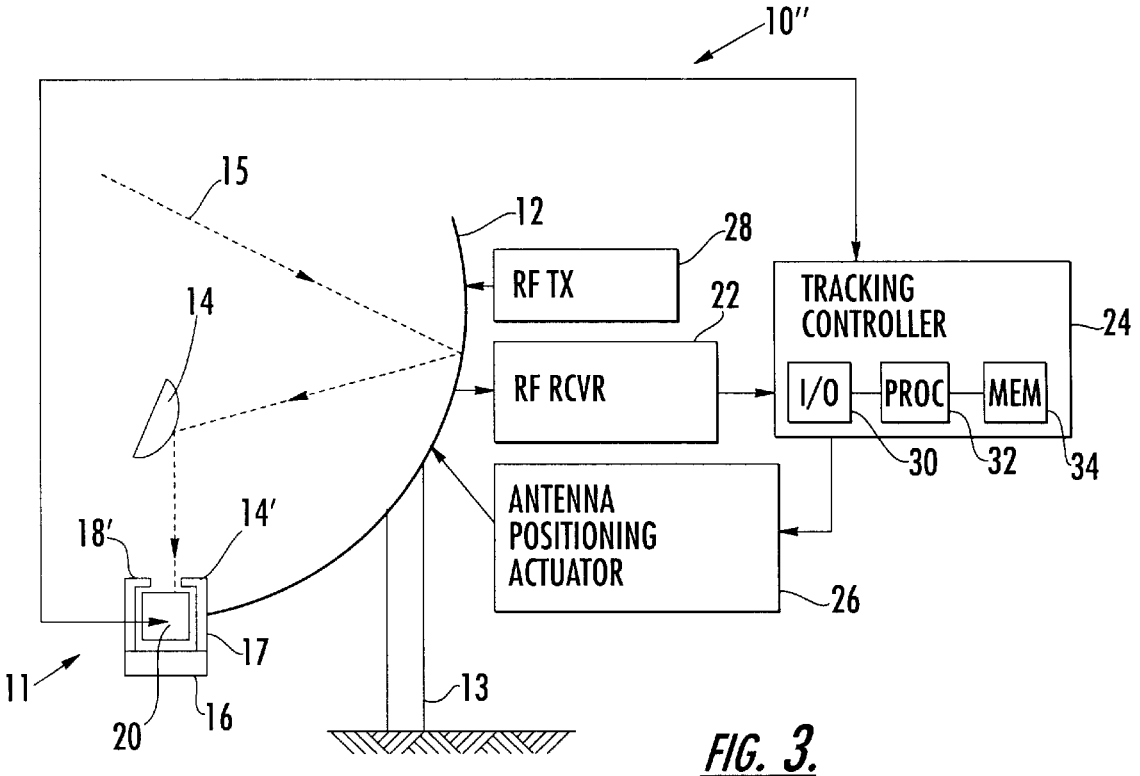
FIG. 3 is a schematic diagram of an antenna apparatus according to a further embodiment of the present invention.

Referring to FIG. 3, an antenna apparatus 10" according to another embodiment of the present invention will now be described. Here, the antenna apparatus 10" is an offset feed antenna having a main reflector 12 and a secondary reflector or sub-reflector 14. The offset feed design is valued for its excellent RF performance in gain, side lobes and efficiency. Here, the antenna feed 20 is offset from the center of the main reflector 12 which includes a parabolic section-shaped dish as would be readily appreciated by the skilled artisan. The sub-reflector 14 has a substantially hyperbolic reflector surface and is mounted on a support structure positioned so that the focal point of its hyperbolic surface lies at the offset antenna feed 20. An incoming RF signal is thus reflected from the surface of the main reflector 12, off the surface of the sub-reflector 14, to the offset antenna feed 20.

Again, the antenna feed 20 is connected to a receiver 22, and the dimensions and shape of the sub-reflector 14 and of the antenna feed 20 are determined so that the received signal is focused into the antenna feed. As discussed above, the controller 24 is connected to the receiver 22 and modifies the antenna apparatus 10 properties to produce an antenna beam pattern. Unlike the embodiment described with reference to FIG. 2, in this embodiment, the conical scan device 11 has the body 18' carried by the support member 17 and driven by drive 16 to intercept the signal path 15 between the sub-reflector 14 and the antenna feed 20 as shown in FIG. 3. This dual ring format drive 16 is preferably mounted, for example, around/adjacent the antenna feed 20 and opposite the sub-reflector 14. Additionally, as illustrated in FIG. 3, the body 18' and the counterweight body 19', in this embodiment, may extend inwardly from the support member 17.

A ring focus antenna begins with a reflector/subreflector configuration as depicted in FIG. 3. The cross-section is then rotated about the subreflector-to-feed axis. The resultant geometry resembles the embodiment of FIG. 2. The main reflector 12 and the subreflector 14 are shaped surfaces to satisfy the geometrical optics needs, in place of the parabolic and hyperbolic structure of the Cassegrain antenna ensemble which is physically similar in appearance.

Figure 5:
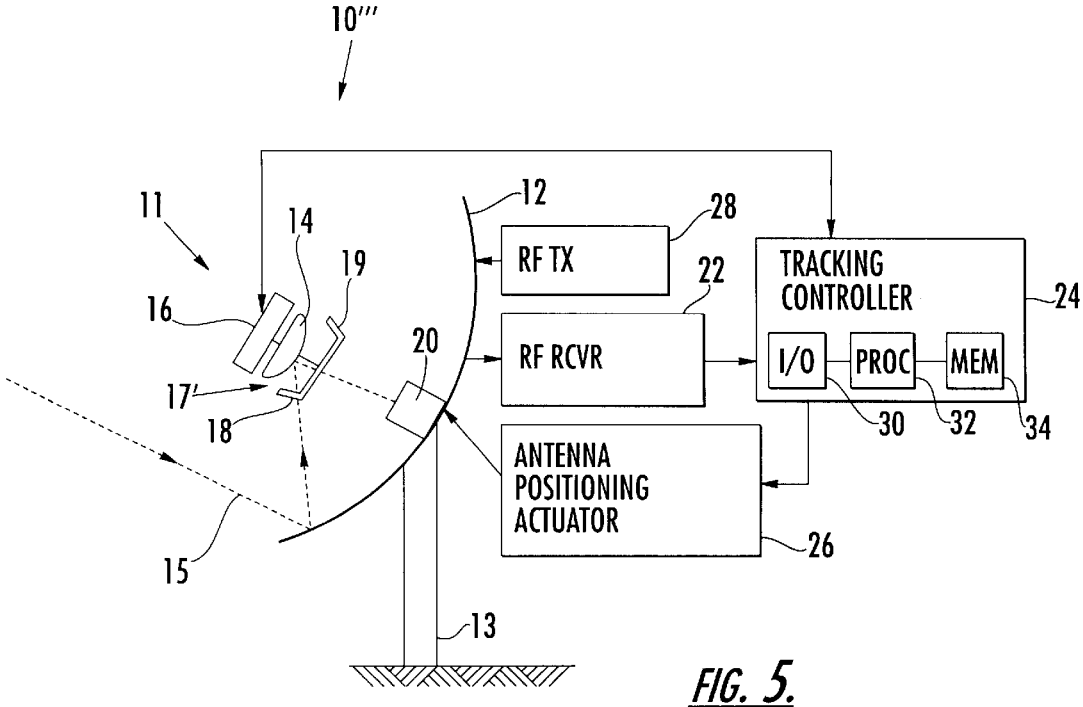
FIG. 5 is a schematic diagram of an antenna apparatus according to a further embodiment of the present invention.

Referring to FIG. 5, the conical scan device 11 may include a body 18 carried by a disk shaped support structure 17' which could be mounted in front of the subreflector 14 and rotated by a drive 16. A small hole in the subreflector 14 would allow a drive shaft to pass through the subreflector and attach to the support structure 17'. Again, a counter weight 19 would be mounted opposite the body 18 to avoid a rotary imbalance. The counterweight 19 and the support structure 17' would be transparent to RF signals.

Each of the illustrated embodiments may be manufactured as a new system or redesigned from an existing system by retrofitting a conventional antenna apparatus (e.g. Cassegrain or ring focus) with the conical scan device 11 including the drive 16, support 17, movable body 18, and counterweight body 19. Of course such a retrofitted existing system would also be modified to include the control necessary to track a target using the conical scan device 11. The conical scan device 11 of the present invention is significantly less expensive than typical monopulse tracking approaches, and requires minimal redesign of an existing antenna apparatus to implement it. Moreover, due to the lightweight and low inertia of the conical scan device 11, it has the potential to provide high scan rates even during high dynamic maneuvers by the antenna apparatus 10.

Additionally, the body 18 in the signal path 15 may not have to be rotated by a drive 16. The body 18 could be made from a material, such as a thin film ferro-electric or barium strontium titanate (BST), for example, of which portions of could vary in RF blocking or opaqueness as a function of applied energy. By energizing portions of a body 18, made from such a material, in a predetermined pattern, the error gradient could be generated with no moving parts.

A method aspect of the invention includes tracking a target with the antenna apparatus 10 including the steps of modulating received RF signals by moving the body 18 in the received signal path 15. Again, the movable body has at least one predetermined characteristic to modulate received RF signals, and an antenna pointing control signal is generated based upon modulated received RF signals. Again, the movable body 18 preferably blocks incoming RF signals, and may comprise an RF opaque material or a frequency dependent RF opaque material as discussed above.

For the method, the antenna apparatus 10 may further comprise a sub-reflector 14 positioned in the received signal path 15 for reflecting received RF signals from the main reflector 12 to the antenna feed 20, and thus the movable body 18 may intercept the signal path 15 between the main reflector and the sub-reflector. A position of the movable body 18 may be detected, and thus the antenna pointing control signal may also be generated in response to a detected position of the movable body. Also, the method may include the step of determining an antenna pointing error. The drive speed and movable body 18 position are combined with the incoming RF signal strength to create a relationship between incoming RF signal and the angle of the movable body 18. From this relationship, an error gradient curve can be generated (e.g. as shown in FIG. 6), and the direction and relative magnitude of the pointing error between the antenna apparatus 10 and the target can be determined.

The above description refers to the ring focus and Cassegrain antenna forms to focus the conceptual understanding of the invention. However, other antenna configurations such as Gregorian, Newtonian, phased arrays, beam waveguides, etc. should not be excluded. Also, in the description, an elevation over azimuth axis gimbal arrangement is used to illustrate the inventive concept. The pointing and tracking corrections provided by the described technique to generate an error gradient may be used on other gimbal configurations. For example, typical other configurations include (x,y), multiple axes, multiple axes with cant angle elements, etc.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna apparatus comprising:

an antenna feed;

a radio frequency (RF) receiver connected to the antenna feed;

a main reflector for reflecting received RF signals to the antenna feed along a received signal path;

a body in the received signal path and having at least one predetermined characteristic to modulate received RF signals; and a tracking controller connected to the RF receiver for generating an antenna pointing control signal based upon modulated received RF signals.

2. An antenna apparatus according to claim 1 wherein the at least one predetermined characteristic comprises at least partially blocking received RF signals.

3. An antenna apparatus according to claim 1 wherein the at least one predetermined characteristic comprises blocking received RF signals and not blocking other RF signals.

4. An antenna apparatus according to claim 1 further comprising a sub-reflector positioned in the received signal path for reflecting received RF signals from the main reflector to the antenna feed.

5. An antenna apparatus according to claim 4 wherein the body is movable in the received signal path between the main reflector and the sub-reflector.

6. An antenna apparatus according to claim 4 wherein the body is movable in the received signal path between the sub-reflector and the antenna feed.

7. An antenna apparatus according to claim 1 wherein the body modulates received RF signals by at least partially blocking received RF signals in a predetermined pattern in the received signal path.

8. An antenna apparatus according to claim 1 further comprising:

a drive for rotating the body; and a counterweight for the body connected to the drive.

9. An antenna apparatus according to claim 8 wherein the tracking controller controls the speed of the drive.

10. An antenna apparatus according to claim 1 further comprising a position sensor connected to the tracking controller for sensing a position of the body.

11. An antenna apparatus according to claim 1 wherein the tracking controller determines an antenna pointing error; and wherein the tracking controller also generates the antenna pointing control signal based upon the antenna pointing error.

12. An antenna apparatus according to claim 1 wherein the main reflector comprises a dish; and wherein the antenna feed is positioned at an apex of the dish.

13. An antenna apparatus according to claim 1 wherein the main reflector comprises a dish; and wherein the antenna feed is positioned offset from an apex of the dish.

14. An antenna apparatus comprising:

an antenna feed;

a radio frequency (RF) receiver connected to the antenna feed;

a main reflector for reflecting received RF signals to the antenna feed along a received signal path;

a sub-reflector positioned in the received signal path for reflecting received RF signals from the main reflector to the antenna feed;

a body movable in the received signal path for blocking received RF signals; and a tracking controller connected to the RF receiver for generating an antenna pointing control signal based upon modulated received RF signals.

15. An antenna apparatus according to claim 14 wherein the body does not block other RF signals.

16. An antenna apparatus according to claim 14 wherein the body is movable in the received signal path between the main reflector and the sub-reflector.

17. An antenna apparatus according to claim 14 wherein the body is movable in the received signal path between the sub-reflector and the antenna feed.

18. An antenna apparatus according to claim 14 wherein the body is rotatably mounted adjacent the sub-reflector.

19. An antenna apparatus according to claim 14 wherein the body is rotatably mounted adjacent the antenna feed.

20. An antenna apparatus according to claim 14 further comprising:

a drive for rotating the body; and a counterweight for the body connected to the drive.

21. An antenna apparatus according to claim 20 wherein the tracking controller controls the speed of the drive.

22. An antenna apparatus according to claim 14 further comprising a position sensor connected to the tracking controller for sensing a position of the body; and wherein the tracking controller also generates the antenna pointing control signal based upon the position of the body.

23. An antenna apparatus according to claim 14 wherein the tracking controller determines an antenna pointing error.

24. A tracking apparatus for a reflector antenna including an antenna feed, a radio frequency (RF) receiver connected to the antenna feed, and a main reflector for reflecting received RF signals to the antenna feed along a received signal path, the tracking device comprising:

a body movable in the received signal path and having at least one predetermined characteristic to modulate received RF signals;

a drive for moving the body in the received signal path; and a tracking controller for connection to the RF receiver for generating an antenna pointing control signal based upon modulated received RF signals.

25. A tracking apparatus according to claim 24 wherein the at least one predetermined characteristic comprises blocking received RF signals.

26. A tracking apparatus according to claim 24 wherein the at least one predetermined characteristic comprises blocking received RF signals and not blocking other RF signals.

27. A tracking apparatus according to claim 24 wherein the antenna further includes a sub-reflector positioned in the received signal path for reflecting received RF signals from the main reflector to the antenna feed; and wherein the body is movable in the received signal path between the main reflector and the sub-reflector.

28. A tracking apparatus according to claim 24 wherein the antenna further includes a sub-reflector positioned in the received signal path for reflecting received RF signals from the main reflector to the antenna feed; and wherein the body is movable in the received signal path between the sub-reflector and the antenna feed.

29. A tracking apparatus according to claim 24 wherein the drive is mountable adjacent the sub-reflector.

30. A tracking apparatus according to claim 24 wherein the drive is mountable adjacent the antenna feed.

31. A tracking apparatus according to claim 24 wherein the drive comprises a motor for rotating the body.

32. A tracking apparatus according to claim 24 wherein the tracking controller controls the speed of the drive.

33. A tracking device according to claim 24 further comprising a position sensor connected to the tracking controller for sensing a position of the body; and wherein the tracking controller also generates the antenna pointing control signal based upon the position of the body.

34. A tracking device according to claim 24 wherein the tracking controller determines an antenna pointing error.

35. A method of tracking a target with a reflector antenna including an antenna feed, a radio frequency (RF) receiver connected to the antenna feed, and a main reflector for reflecting received RF signals to the antenna feed along a received signal path, the method comprising the steps of:

modulating received RF signals by moving a body in the received signal path, the body having at least one predetermined characteristic to modulate received RF signals; and generating an antenna pointing control signal based upon modulated received RF signals.

36. A method according to claim 35 wherein the at least one predetermined characteristic comprises blocking received RF signals.

37. A method according to claim 35 wherein the at least one predetermined characteristic comprises blocking received RF signals and not blocking other RF signals.

38. A method according to claim 35 wherein the antenna further includes a sub-reflector positioned in the received signal path for reflecting received RF signals from the main reflector to the antenna feed; and wherein the body is movable in the received signal path between the main reflector and the sub-reflector.

39. A method according to claim 35 wherein the antenna further includes a sub-reflector positioned in the received signal path for reflecting received RF signals from the main reflector to the antenna feed; and wherein the body is movable in the received signal path between the sub-reflector and the antenna feed.

40. A method according to claim 35 wherein moving the body comprises rotating the body with a motor.

41. A method according to claim 40 further comprising the step of controlling the speed of the motor.

42. A method according to claim 35 further comprising the step of sensing a position of the body; and wherein the antenna pointing control signal is also generated based upon a sensed position of the body.

43. A method according to claim 35 further comprising the step of determining an antenna pointing error.

44. A method of tracking a target with a reflector antenna including an antenna feed, a radio frequency (RF) receiver connected to the antenna feed, and a main reflector for reflecting received RF signals to the antenna feed along a received signal path, the method comprising the steps of:

modulating received RF signals by at least partially blocking received RF signals in a predetermined pattern in the received signal path; and generating an antenna pointing control signal based upon modulated received RF signals.

45. A method according to claim 44 wherein at least partially blocking received RF signals comprises blocking the received RF signals.

46. A method according to claim 44 wherein received RE signals are blocked and other RF signals are not blocked.

47. A method according to claim 44 wherein the antenna further includes a sub-reflector positioned in the received signal path for reflecting received RF signals from the main reflector to the antenna feed; and wherein the received RF signals are at least partially blocked in the received signal path between the main reflector and the sub-reflector.

48. A method according to claim 44 wherein the antenna further includes a sub-reflector positioned in the received signal path for reflecting received RF signals from the main reflector to the antenna feed; and wherein the received RF signals are at least partially blocked in the received signal path between the sub-reflector and the antenna feed.

49. A method according to claim 44 wherein at least partially blocking the received RF signals comprises rotating a body in the received signal path with a motor.

50. A method according to claim 44 wherein at least partially blocking the received RF signals comprises changing an RF blocking characteristic of a body in the received signal path.

51. A method according to claim 44 further comprising the step of determining an antenna pointing error.

* * * * *